US009134059B2

(12) United States Patent
Chung et al.

(10) Patent No.: US 9,134,059 B2
(45) Date of Patent: Sep. 15, 2015

(54) SUPERCOOLING NON-FREEZING COMPARTMENT FOR REFRIGERATOR APPLIANCE

(75) Inventors: Won-Young Chung, Changwon-si (KR); Jae-Hyun Soh, Paju-si (KR); Cheol-Hwan Kim, Changwon-si (KR); Ju-Hyun Kim, Jinhae-si (KR)

(73) Assignee: LG ELECTRONICS INC., Seoul (KR)

( * ) Notice: Subject to any disclaimer, the term of this patent is extended or adjusted under 35 U.S.C. 154(b) by 1101 days.

(21) Appl. No.: 13/143,685

(22) PCT Filed: Jan. 7, 2010

(86) PCT No.: PCT/KR2010/000097

§ 371 (c)(1),
(2), (4) Date: Aug. 31, 2011

(87) PCT Pub. No.: WO2010/079974

PCT Pub. Date: Jul. 15, 2010

(65) Prior Publication Data

US 2011/0303103 A1 Dec. 15, 2011

(30) Foreign Application Priority Data

Jan. 8, 2009 (KR) ..... 10-2009-0001668
Nov. 10, 2009 (KR) ..... 10-2009-0108309

(51) Int. Cl.

| | |
|---|---|
| ***F25C 1/00*** | (2006.01) |
| ***F25C 5/00*** | (2006.01) |
| ***F25D 23/12*** | (2006.01) |
| ***F25D 29/00*** | (2006.01) |

(52) U.S. Cl.

CPC . *F25C 1/00* (2013.01); *F25C 5/005* (2013.01); *F25D 23/126* (2013.01); *F25D 29/00* (2013.01); *F25C 2301/002* (2013.01); *F25C 2600/04* (2013.01); *F25D 2323/023* (2013.01); *F25D 2700/12* (2013.01)

(58) Field of Classification Search

CPC ..... F25D 23/126; F25D 23/123; F25D 23/12; F25D 2323/023; F25C 2301/002; F25C 1/00
USPC ..... 62/441, 337, 405, 407, 408, 419, 62; 312/402, 404, 407, 407.1, 405.1, 321.5
See application file for complete search history.

(56) References Cited

U.S. PATENT DOCUMENTS

| | | | | |
|---|---|---|---|---|
| 7,032,408 | B2 * | 4/2006 | Dentella et al. | 62/441 |
| 2008/0134712 | A1 * | 6/2008 | Civanelli | 312/404 |
| 2010/0205986 | A1 * | 8/2010 | Chung et al. | 62/159 |

FOREIGN PATENT DOCUMENTS

| | | | | |
|---|---|---|---|---|
| EP | 1 813 896 | A2 | 8/2007 | |
| EP | 1 980 808 | A2 | 10/2008 | |
| KR | 10-2007-0075675 | A | 7/2007 | |
| KR | 10-2008-0090928 | A | 10/2008 | |
| WO | WO 2009/038425 | A2 | 3/2009 | |
| WO | WO-2009038424 | A2 * | 3/2009 | F25D 23/12 |

* cited by examiner

*Primary Examiner* — Cheryl J Tyler
*Assistant Examiner* — Orlando E Aviles Bosques
(74) *Attorney, Agent, or Firm* — Birch, Stewart, Kolasch & Birch, LLP

(57) ABSTRACT

The present invention relates to a cooling apparatus with a passage therein to introduce the cool air from a cooling space into a non-freezing apparatus to cool a lower space of the non-freezing apparatus. A cooling apparatus includes a cooling space supplied with the cool air, a non-freezing apparatus installed in the cooling space and storing food in a non-frozen state, a cooling passage for introducing the cool air from the cooling space into the non-freezing apparatus, and a discharge passage for discharging the flow from the non-freezing apparatus to the cooling space.

10 Claims, 14 Drawing Sheets

SUPERCOOLING NON-FREEZING COMPARTMENT FOR REFRIGERATOR APPLIANCE

TECHNICAL FIELD

The present invention relates to a cooling apparatus including a non-freezing apparatus, and, more particularly to, a cooling apparatus including a non-freezing apparatus which can be provided in a cooling apparatus such as a general refrigerator without significantly modifying the construction of the cooling apparatus and which can store food and beverages in a non-frozen state and easily make slush particularly in the beverages.

BACKGROUND ART

Supercooling means the phenomenon that a molten object or a solid is not changed although it is cooled to a temperature below the phase transition temperature in an equilibrium state. A material has a stable state at every temperature. If the temperature is slowly changed, the constituent elements of the material can follow the temperature changes, maintaining the stable state at each temperature. However, if the temperature is suddenly changed, since the constituent elements cannot be changed to the stable state at each temperature, the constituent elements maintain a stable state of the initial temperature, or some of the constituent elements fail to be changed to a state of the final temperature.

For example, when water is slowly cooled, it is not temporarily frozen at a temperature below 0° C. However, when water enters a supercooled state, it has a kind of quasi-stable state. As this unstable equilibrium state is easily broken even by slight stimulation, water tends to move to a more stable state. That is, if a small piece of material is put into the supercooled liquid, or if the liquid is suddenly shaken, the liquid starts to be frozen at once such that its temperature reaches the freezing point, and maintains a stable equilibrium state at this temperature.

In general, an electrostatic atmosphere is made in a refrigerator and meat and fish are thawed in the refrigerator at a minus temperature. In addition to the meat and fish, fruit is kept fresh in the refrigerator.

This technology uses a supercooling phenomenon. The supercooling phenomenon indicates the phenomenon that a molten object or a solid is not changed although it is cooled to a temperature below the phase transition temperature in an equilibrium state. This technology includes Korean Patent Publication No. 2000-0011081 titled "Electrostatic field processing method, electrostatic field processing apparatus, and electrodes therefor".

FIG. 1 is a view of an example of a conventional thawing and freshness-keeping apparatus. A keeping-cool room 1 is composed of a thermal insulator 2 and an outer wall 5. A mechanism (not shown) controlling a temperature inside the room 1 is installed therein. A metal shelf 7 installed in the room 1 has a two-layer structure. Target objects to be thawed or freshness-kept and ripened such as vegetables, meat and marine products are loaded on the respective layers. The metal shelf 7 is insulated from the bottom of the room 1 by an insulator 9. In addition, since a high voltage generator 3 can generate 0 to 5000 V of DC and AC voltages, an insulation plate 2*a* such as vinyl chloride, etc. is covered on the inside of the thermal insulator 2. A high-voltage cable 4 outputting the voltage of the high voltage generator 3 is connected to the metal shelf 7 after passing through the outer wall 5 and the thermal insulator 2.

When a user opens a door installed at the front of the keeping-cool room 1, a safety switch 13 (see FIG. 2) is turned off to intercept the output of the high voltage generator 3.

FIG. 2 is a circuit configuration view of the high voltage generator 3. 100 V of AC is supplied to a primary side of a voltage regulation transformer 15. Reference numeral 11 represents a power lamp and 19 a working state lamp. When the door 6 is closed and the safety switch 13 is on, a relay 14 is operated. This state is displayed by a relay operation lamp 12. Relay contact points 14*a*, 14*b* and 14*c* are closed by the operation of the relay 14, and 100 V of AC is applied to the primary side of the voltage regulation transformer 15.

The applied voltage is regulated by a regulation knob 15*a* on a secondary side of the voltage regulation transformer 15, and the regulated voltage value is displayed on a voltmeter. The regulation knob 15*a* is connected to a primary side of a boosting transformer 17 on the secondary side of the voltage regulation transformer 15. The boosting transformer 17 boosts the voltage at a ratio of 1:50. For example, when 60 V of voltage is applied, it is boosted to 3000 V.

One end $O_1$ of the output of the secondary side of the boosting transformer 17 is connected to the metal shelf 7 insulated from the keeping-cool room 1 through the high-voltage cable 4, and the other end $O_2$ of the output is grounded. Moreover, since the outer wall 5 is grounded, if the user touches the outer wall 5 of the keeping-cool room 1, he/she does not get an electric shock. Further, in FIG. 1, when the metal shelf 7 is exposed in the room 1, it should be maintained in an insulated state in the room 1. Thus, the metal shelf 7 needs to be separated from the wall of the room 1 (the air performs an insulation function). Furthermore, if a target object 8 is protruded from the metal shelf 7 and brought into contact with the wall of the room 1, the current flows to the ground through the wall of the room 1. Therefore, the insulation plate 2*a* is attached to the inner wall to prevent drop of the applied voltage. Still furthermore, when the metal shelf 7 is covered with vinyl chloride without being exposed in the room 1, an electric field atmosphere is produced in the entire room 1.

In the prior art, an electric field or a magnetic field is applied to the received object to be cooled, such that the received object enters a supercooled state. Accordingly, a complicated apparatus for producing the electric field or the magnetic field should be provided to keep the received object in the supercooled state, and the power consumption is increased during the production of the electric field or the magnetic field. Additionally, the apparatus for producing the electric field or the magnetic field should further include a safety device (e.g., an electric or magnetic field shielding structure, an interception device, etc.) for protecting the user from high power, when producing or intercepting the electric field or the magnetic field.

Japanese Patent Publication No. 2001-4260 discloses a supercooling control refrigerator which includes a temperature detection means and a control means controlling the temperature at a given set temperature in an openable/closable thermal insulation unit and which keeps the goods cold at a temperature below the freezing point during the supercooling operation. However, since the refrigerator controls the rotation number of a cool air circulation fan to adjust the temperature in the thermal insulation unit, if the temperature in the unit is reduced to a temperature below the set temperature, there is no means for raising the temperature to the set temperature within a short time. When the temperature in the unit is maintained at a temperature below the set temperature for a predetermined time, the goods intended to be stored in a supercooled state are frozen. In addition, the frozen goods cannot be thawed and stored again in the supercooled state. The refrigerator has low stability in maintaining a non-frozen state.

Korean Patent Registration No. 10-850062 describes a refrigerator having a space for receiving food and a storing room for cooling the space, the refrigerator including a cool air flowing space directly cooling the food receiving space and a thermal insulation layer insulating the cool air flowing space from the space, and storing the food in a supercooled state. However, if the temperature in the refrigerator is reduced to a temperature below a set temperature, there is no construction for raising the temperature. Therefore, the refrigerator also has low stability in maintaining a non-frozen state.

Japanese Patent Publication No. 2008-267646 discloses a refrigerator with a supercooling room which includes a freezing chamber with a temperature control means therein to continuously adjust the temperature between 0° C. and a temperature of a freezing temperature zone by stages, the supercooling room disposed in the freezing chamber and receiving the cool air from the freezing chamber, and a control apparatus controlling the freezing chamber so that the food stored in the supercooling room can be maintained in a supercooled state at a temperature below the freezing point without being frozen. The temperature of the freezing chamber or a switching chamber in which the supercooling room is installed is controlled to adjust the temperature of the supercooling room. The supercooling room is sealed with respect to the freezing chamber or the switching chamber such that a temperature change in the supercooling room is limited. However, when the food is stored in the supercooled state by slowing down the temperature change in the supercooling room by indirect cooling, it takes a long time for the food to reach the supercooled state. Moreover, if the temperature in the refrigerator is reduced to a temperature below a set temperature, there is no construction for raising the temperature. Accordingly, the refrigerator also has low stability in maintaining a non-frozen state.

DISCLOSURE

Technical Problem

An object of the present invention is to provide a cooling apparatus with a passage therein to introduce the cool air from a cooling space into a non-freezing apparatus to cool a lower space of the non-freezing apparatus.

Another object of the present invention is to provide a cooling apparatus including a non-freezing apparatus which can be installed in a freezing chamber, a refrigerating chamber, a freezing chamber door, or a refrigerating chamber door of a refrigerator which is a general cooling apparatus without modifying the construction of the cooling apparatus and which can stably store food in a non-frozen state.

A further object of the present invention is to provide a cooling apparatus including a non-freezing apparatus which can rapidly change a liquid to a supercooled state by producing a forcible flow using a flow fan.

Technical Solution

According to an aspect of the present invention, there is provided a cooling apparatus, including: a cooling space supplied with the cool air; a non-freezing apparatus installed in the cooling space and storing food in a non-frozen state; a cooling passage for introducing the cool air from the cooling space into the non-freezing apparatus; and a discharge passage for discharging the flow from the non-freezing apparatus to the cooling space. In addition, the non-freezing apparatus includes a cooling fan producing a forcible flow so that the cool air can be circulated to the cooling passage and the discharge passage. Moreover, the non-freezing apparatus includes a bulkhead separating the cooling passage and the discharge passage from each other.

Further, the non-freezing apparatus includes a damper installed on the cooling passage and controlling the inflow of the cool air.

Furthermore, the non-freezing apparatus includes a lower space maintained at a temperature of the maximum ice crystal formation zone, an upper space maintained at a higher temperature than the lower space, and a rear space located at the rear of the lower space, and the cooling passage is formed to introduce the cool air from the cooling apparatus into the lower space via the rear space.

Still furthermore, the non-freezing apparatus includes a lower space maintained at a temperature of the maximum ice crystal formation zone, an upper space maintained at a higher temperature than the lower space, and a rear space located at the rear of the lower space, and the discharge passage includes a discharge passage for discharging the flow from the lower space to the cooling apparatus directly and a discharge passage for discharging the flow from the lower space to the cooling apparatus via the rear space. According to another aspect of the present invention, there is provided a cooling apparatus, including: a cooling space supplied with the cool air; a non-freezing apparatus installed in the cooling space and including a lower space maintained at a temperature of the maximum ice crystal formation zone, an upper space maintained at a higher temperature than the lower space, and a rear space located at the rear of the lower space; and a cooling passage formed between the lower space and the rear space.

In addition, the non-freezing apparatus includes a first discharge hole for discharging the flow from the lower space to the rear space.

Moreover, the non-freezing apparatus includes a second discharge hole for discharging some of the discharged flow to the cooling space.

Further, the non-freezing apparatus includes a damper controlling the inflow of the cool air from the cooling space to the rear space.

Furthermore, the non-freezing apparatus includes a flow hole for introducing the cool air introduced through the damper into the lower space.

Still furthermore, the non-freezing apparatus includes a second discharge hole for discharging some of the discharged flow to the cooling space, and a bulkhead is formed between the damper and the second discharge hole.

Still furthermore, the non-freezing apparatus includes a flow fan installed on the flow hole and producing a forcible flow.

Still furthermore, the non-freezing apparatus includes a first discharge hole for discharging the flow from the lower space to the rear space, and a bulkhead is formed between the flow hole and the first discharge hole.

Still furthermore, the non-freezing apparatus includes a third discharge hole for discharging the flow from the lower space to the cooling space.

Still furthermore, one or more bulkheads are provided in the rear space of the non-freezing apparatus, and the rear space is partitioned into two or more spaces by the bulkhead, a damper for introducing the cool air from the cooling space and a flow hole for allowing the introduced cool air to flow into the lower space being formed in at least one space, a first discharge hole for discharging the cool air from the lower space to the rear space and a second discharge hole for discharging the cool air from the rear space to the cooling space being formed in at least one another space.

Still furthermore, the non-freezing apparatus includes a fourth discharge hole formed in the same space as the damper and the flow hole to discharge the cool air from the lower space to the rear space when the damper is closed.

Still furthermore, the fourth discharge hole is smaller in size than the first and second discharge holes.

Still furthermore, the non-freezing apparatus includes a fifth discharge hole for discharging the cool air to the rear of the rear space.

Still furthermore, a rib defining a gap from the installation surface of the cooling apparatus is formed on the rear surface of the non-freezing apparatus.

Advantageous Effects

According to the cooling apparatus provided by the present invention, since the non-freezing apparatus is detachably mounted in the freezing chamber, the refrigerating chamber, the freezing chamber door, the refrigerating chamber door, or the like without significantly modifying the construction of the general cooling apparatus, the food can be stably stored in the non-frozen state in the non-freezing apparatus.

According to the cooling apparatus provided by the present invention, since the non-freezing apparatus is spaced apart from the installation surface of the cooling apparatus by a given gap, the temperature of the installation surface of the cooling apparatus less affects the non-freezing apparatus, and the cool air can be introduced and discharged through the gap. Therefore, the food stored in the non-freezing apparatus can be cooled to the non-frozen state within a short time.

The non-freezing apparatus of the cooling apparatus provided by the present invention includes the flow fan producing the forcible flow, so that a liquid contained in a container can have the utmost uniform temperature distribution.

MODE FOR INVENTION

Hereinafter, the present invention will be described in detail with reference to the exemplary embodiments and the accompanying drawings.

Figure 1:
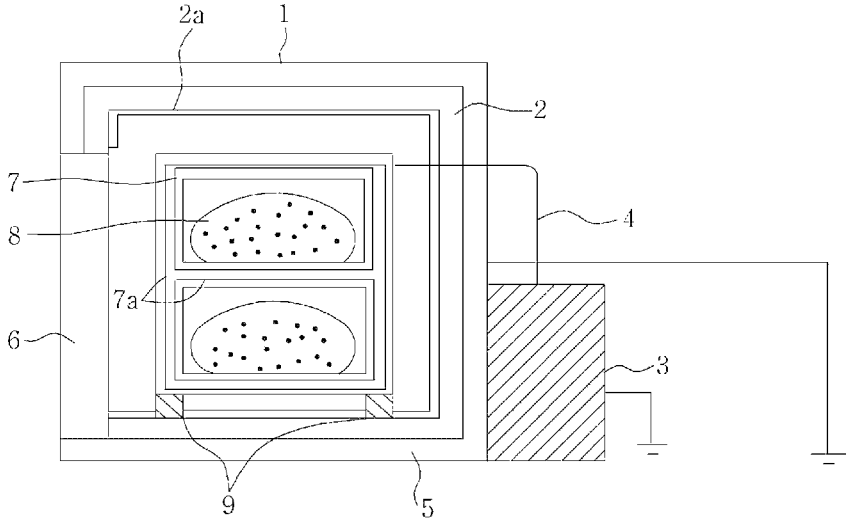
FIG. 1 is a view of an example of a conventional thawing and freshness-keeping apparatus.
Figure 2:
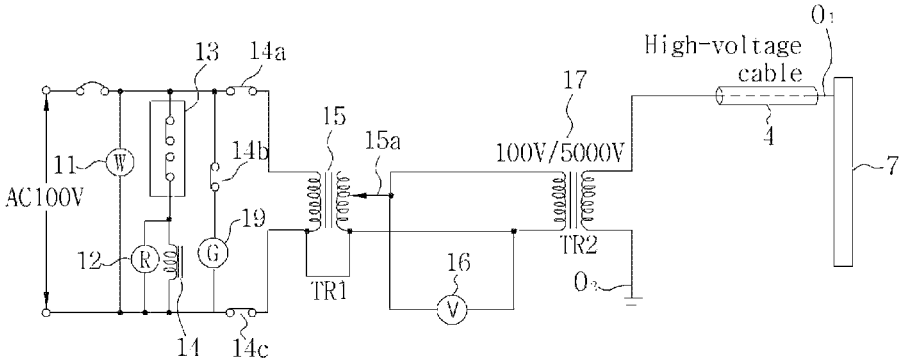
FIG. 2 is a circuit configuration view of a high voltage generator.
Figure 3:
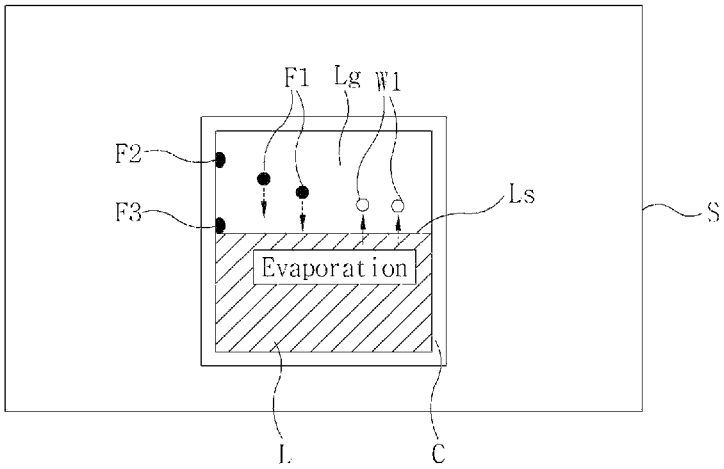
FIG. 3 is a view showing a supercooling process applied to a slush making container, a non-freezing apparatus and a cooling apparatus according to the present invention.

FIG. 3 is a view showing a supercooling process applied to a non-freezing apparatus and a cooling apparatus according to the present invention. As illustrated in FIG. 3, a container C containing a liquid L is cooled in a cooling space S.

For example, it is assumed that a cooling temperature of the cooling space S is lowered from a room temperature to a temperature below 0° C. (the phase transition temperature of water) or a temperature below the phase transition temperature of the liquid L. While the cooling is carried out, it is intended to maintain the water or the liquid L in a supercooled state at a temperature below the maximum ice crystal formation zone (about −1° C. to −5° C.) of the water in which the formation of ice crystals is maximized, or at a cooling temperature below the maximum ice crystal formation zone of the liquid L.

The liquid L is evaporated during the cooling such that vapor is introduced into a gas Lg (or a space) in the container C. In a case where the container C is closed by a cover Ck, the gas Lg may be supersaturated due to the evaporated vapor. In this description, the container C may selectively include the cover Ck. If the container C includes the cover Ck, it can prevent, to some extent, the cool air from being introduced directly from the cooling space or from reducing the temperature of the surface of the liquid L or the temperature of the gas Lg thereon.

When the cooling temperature reaches or exceeds a temperature of the maximum ice crystal formation zone of the liquid L, the vapor in the gas Lg or the water drops on the inner wall of the container C may be frozen. Alternatively, the condensation occurs in a contact portion of the surface Ls of the liquid L and the inner wall of the container C (almost the same as the cooling temperature of the cooling space S) such that the condensed liquid L may form ice crystal nucleuses which are ice crystals.

For example, when the ice crystal nucleuses in the gas Lg are lowered and infiltrated into the liquid L through the surface Ls of the liquid L, the liquid L is released from the supercooled state and caused to be frozen. That is, the supercooling of the liquid L is released.

Alternatively, as the ice crystal nucleuses are brought into contact with the surface Ls of the liquid L, the liquid L may be released from the supercooled state and caused to be frozen.

Therefore, the non-freezing apparatus of the present invention applies or supplies energy (e.g., thermal energy) to the container C received in the cooling space S and the liquid L to control the temperature of the gas Lg and the liquid L, so that the liquid L can be maintained in a non-frozen state, i.e., a supercooled state below its phase transition temperature. Here, the gas Lg is located at a top layer portion of the liquid L in contact therewith. In this description, it is defined as a liquid top layer portion (or received object top layer portion). The liquid top layer portion may be an oil layer which can float in the liquid L or an object which contains plastic or other resin, in addition to the liquid Lg. In this embodiment, for convenience, the liquid L is described as an example. However, the present invention can be applied to general received objects such as meat, fish, vegetables, fruit, etc.

The maintenance of the supercooled state using the temperature control will be described in detail with reference to FIGS. 4 and 5.

Figure 4:
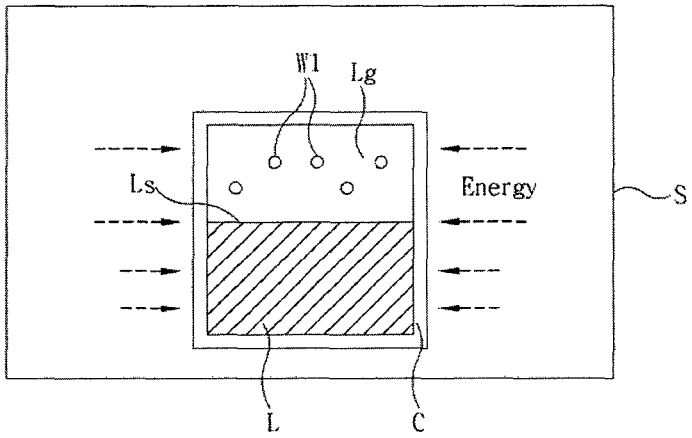
FIG. 4 is a view showing a process of preventing the ice crystal nucleus formation, which is applied to the non-freezing apparatus according to the present invention.

FIG. 4 is a view showing a process of preventing the ice crystal nucleus formation, which is applied to the non-freezing apparatus according to the present invention.

In FIG. 4, to prevent the freezing of the vapor W1 in the gas Lg, i.e., to continuously maintain the vapor W1 state, the energy is applied to at least the gas Lg or the surface Ls of the liquid L so that the temperature of the gas Lg or the surface Ls of the liquid L can be higher than a temperature of the maximum ice crystal formation zone of the liquid L, more preferably, the phase transition temperature of the liquid L. In addition, to prevent the freezing although the surface Ls of the liquid L is brought into contact with the inner wall of the container C, the temperature of the surface Ls of the liquid L is maintained higher than a temperature of the maximum ice crystal formation zone of the liquid L, more preferably, the phase transition temperature of the liquid L.

Accordingly, the liquid L in the container C maintains the supercooled state at a temperature below its phase transition temperature or a temperature below its maximum ice crystal formation zone.

Moreover, when the cooling temperature in the cooling space S is a considerably low temperature, e.g., −20° C., although the energy is applied to an upper portion of the container C, the liquid L which is the received object may not be able to maintain the supercooled state. There is a need that the energy should be applied to a lower portion of the container C to some extent. When the energy applied to the upper portion of the container C is relatively larger than the energy applied to the lower portion of the container C, the temperature of the upper portion of the container C can be maintained higher than the phase transition temperature or a temperature of the maximum ice crystal formation zone. Further, the temperature of the liquid L in the supercooled state can be adjusted by the energy applied to the lower portion of the container C and the energy applied to the upper portion of the container C.

The liquid L has been described as an example with reference to FIGS. 3 and 4. In the case of a received object containing a liquid, when the liquid in the received object is continuously supercooled, the received object can be kept fresh for an extended period of time. The received object can be maintained in the supercooled state at a temperature below the phase transition temperature via the above process. Here, the received object may include meat, vegetables, fruit and other food as well as the liquid.

Furthermore, the energy used in the present invention may be thermal energy, electric or magnetic energy, ultrasonic-wave energy, light energy, and so on.

Figure 5:
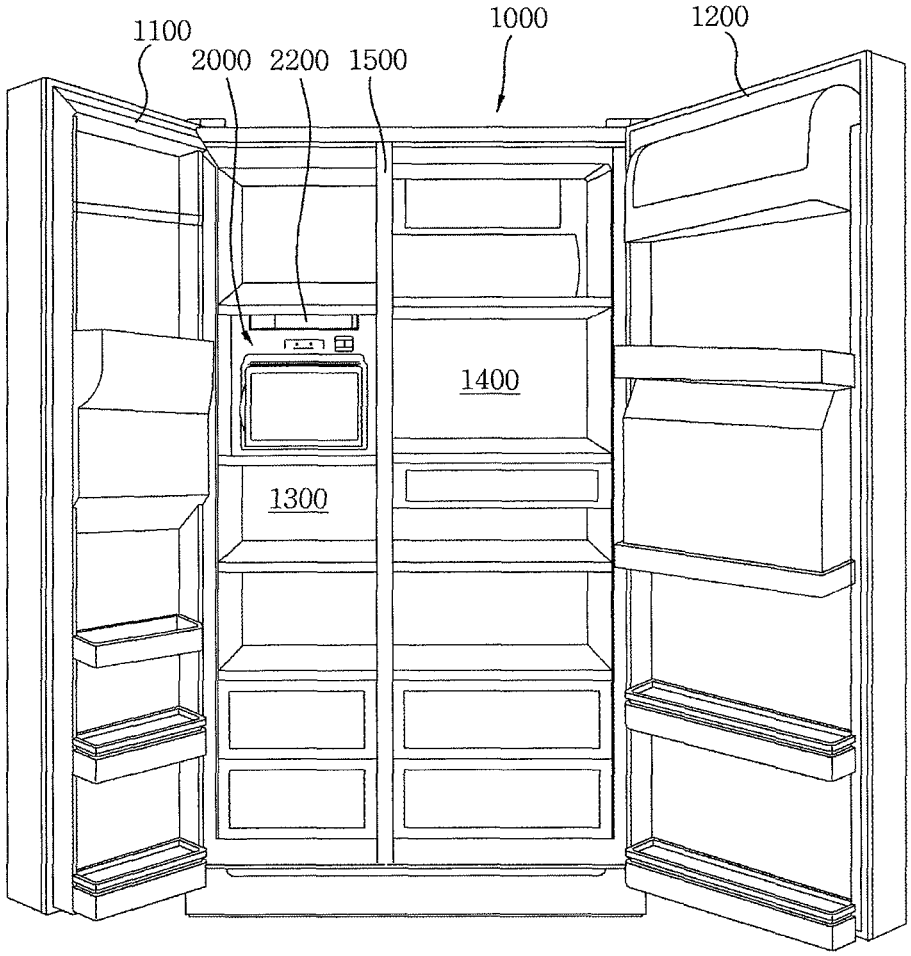
FIG. 5 is a view of a cooling apparatus according to a first embodiment of the present invention.

FIG. 5 is a view of a cooling apparatus according to a first embodiment of the present invention. The cooling apparatus 1000 is an apparatus supplying the cool air into a cooling space 1300 and 1400 using a cooling cycle. FIG. 5 illustrates a state where a non-freezing apparatus 2000 is installed in a freezing chamber 1300 of a side-by-side refrigerator which is an example of the cooling apparatus 1000. The cooling space 1300 and 1400 in the cooling apparatus 1000 is divided into the freezing chamber 1300 and a refrigerating chamber 1400 by a bulkhead 1500. Support portions (not shown) are formed on both sides of the freezing chamber 1300 to protrude therefrom, and hook-shaped ribs 2200 supported by the support portions (not shown) and fixing the non-freezing apparatus 2000 are formed on both side surfaces of the non-freezing apparatus 2000. The non-freezing apparatus 2000 is fixed in the freezing chamber 1300 by the hook-shaped ribs 2200 and the support portions (not shown) and may be detachable from the freezing chamber 1300 like other general shelves. The non-freezing apparatus 2000 needs power supply. Preferably, power connectors (not shown) are provided between the cooling apparatus 1000 and the non-freezing apparatus 2000 and connected to each other to supply power. The power connectors (not shown) may be contact-type connectors such as battery chargers formed in the corresponding positions of the cooling apparatus 1000 and the non-freezing apparatus 2000 and transferring power through the contact, or a pair of female and male port-type connectors engaged with ends of power transfer cables provided in the cooling apparatus 1000 and the non-freezing apparatus 2000, respectively. Additionally, the non-freezing apparatus 2000 may be fixed to the freezing chamber 1300 using screws or the like not to be detached therefrom. In this situation, not a separate power connector (not shown) but a general electric wire is provided between the non-freezing apparatus 2000 and the freezing chamber 1300 to supply power from the cooling apparatus 1000 to the non-freezing apparatus 2000. Meanwhile, when it is intended to display a working state, a supercooling proceeding state and so on of the non-freezing apparatus 2000 through an external display (not shown) installed on the outside of the cooling apparatus 1000, it is preferable to configure the power connector (not shown) or the electric wire to transmit electricity in two ways so as to transfer information from a PCB (not shown) which is a control unit controlling the operation of the non-freezing apparatus 2000 to the external display (not shown) or a control unit (not shown) of the cooling apparatus 1000.

Figure 6:
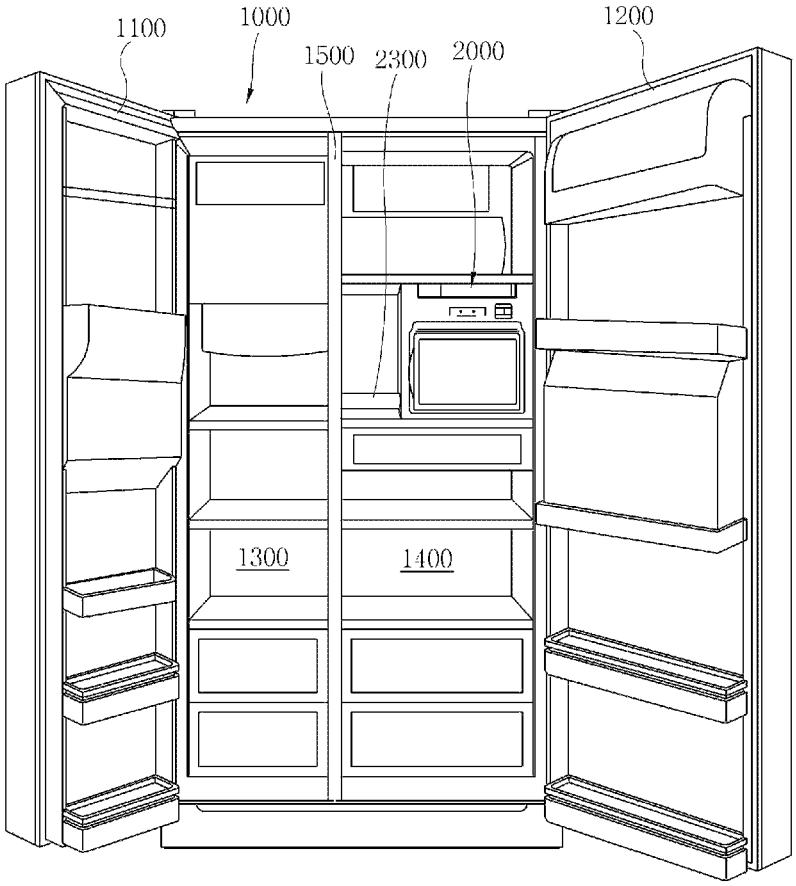
FIG. 6 is a view of a cooling apparatus according to a second embodiment of the present invention.

FIG. 6 is a view of a cooling apparatus according to a second embodiment of the present invention. The cooling apparatus 1000 supplies the cool air into a cooling space 1300 and 1400 using a cooling cycle. FIG. 6 illustrates a state where a non-freezing apparatus 2000 is installed in a refrigerating chamber 1400 of a side-by-side refrigerator which is an example of the cooling apparatus 1000. Normally, the refrigerating chamber 1400 is maintained between a temperature above 0° C. and −2° C. such that a liquid cannot be frozen. Therefore, when the non-freezing apparatus 2000 is installed not in the freezing chamber 1300 but in the refrigerating chamber 1400, required is a cooling passage for introducing the cool air from the freezing chamber 1300 to the non-freezing apparatus 2000 or a damper. For this purpose, the cooling apparatus 1000 includes a cooling passage guide duct 2300 which can pass through a bulkhead 1500 and introduce the cool air into the non-freezing apparatus 2000. Alternatively, the guide duct 2300 may be connected directly to the non-freezing apparatus 2000, so that the cooling passage can be connected directly to the non-freezing apparatus 2000. The guide duct 2300 may not be connected directly to the non-freezing apparatus 2000 but an end portion thereof may be located adjacent to the non-freezing apparatus 2000, so that the cooling passage can supply the cool air to the periphery of the non-freezing apparatus 2000 to indirectly cool the non-freezing apparatus 2000. In addition, a damper controlling the cool air flowing into the non-freezing apparatus 2000 may be provided. The damper may be installed in the guide duct 2300 or on the side of the non-freezing apparatus 2000. If the damper is closed, the non-freezing apparatus 2000 is cooled according to a first cooling method in which the cool air in the cooling apparatus 1000 indirectly cools the non-freezing apparatus 2000. Meanwhile, if the damper is open, while the cool air in the cooling apparatus 1000 is circulated around the non-freezing apparatus 2000 to indirectly cool the non-freezing apparatus 2000, a second cooling method is performed, in which the cool air is introduced into the non-freezing apparatus 2000 through the damper and circulated directly in the non-freezing apparatus 2000. If the damper is provided on the side of the non-freezing apparatus 2000, the guide duct 2300 may cover the damper such that the damper is provided both in the guide duct 2300 and on the non-freezing apparatus 2000. When the non-freezing apparatus 2000 is installed in the refrigerating chamber 1400, it may be detachable from the refrigerating chamber 1400 or fixed to the wall of the refrigerating chamber 1400 using screws or rivets.

Figure 7:
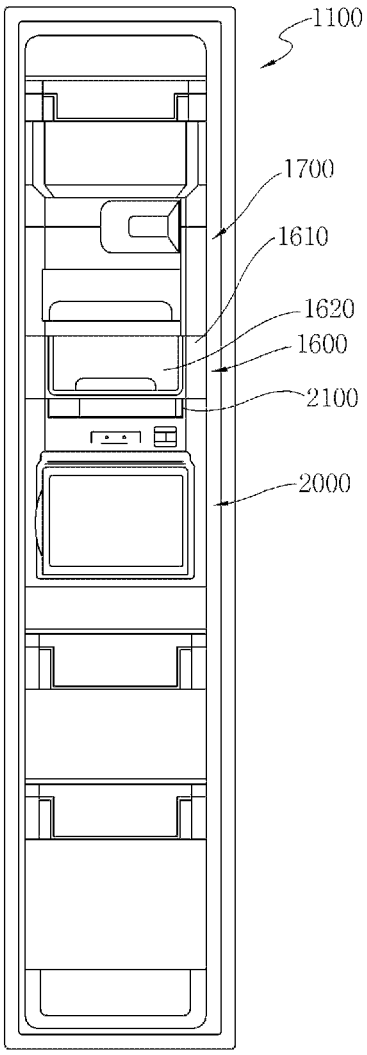
FIG. 7 is a view of a cooling apparatus according to a third embodiment of the present invention.

FIG. 7 is a view of a door provided in a cooling apparatus according to a third embodiment of the present invention. According to the third embodiment of the present invention, a non-freezing apparatus 2000 is installed in a freezing chamber door 1100 of the cooling apparatus 1000. The freezing chamber door 1100 serves to open and close a freezing chamber 1300. The non-freezing apparatus 2000, an ice bank 1600 and an ice maker 1700 are installed in the freezing chamber door 1100 sequentially from the lower side. The ice maker 1700 is supplied with water to make ice. When the ice maker 1700 finishes the ice making, the ice made in the ice maker 1700 is automatically or manually supplied to the ice bank 1600. In a case where the ice is automatically supplied from the ice maker 1700 to the ice bank 1600, an ice tray (not shown) in which the ice is made is rotatably installed in the ice maker 1700 and rotated to drop the ice to the lower side upon the completion of the ice making. The ice bank 1600 includes an outer casing 1610 mounted in the freezing chamber door 1100 and a drawer 1620 which can be pulled out from the outer casing 1610. The outer casing 1610 has an opening portion on the upper side so that the ice dropped from the ice maker 1700 can be introduced therethrough. The ice made in the ice maker 1700 is dropped to the lower portion by the rotation of the ice tray (not shown), passed through the opening portion formed in the outer casing 1610 of the ice bank 1600, and stored in the drawer 1620 of the ice bank 1600. When dropped to the ice bank 1600, the ice gives a shock to the ice bank 1600. This shock may be transferred to the freezing chamber door 1100, the non-freezing apparatus 2000, etc. Accordingly, the non-freezing apparatus 2000 has a groove 2100 having a larger section than that of the drawer 1620. As such, when the ice is dropped to the drawer 1620, the drawer 1620 can be downwardly moved to reduce the shock.

Figure 8:
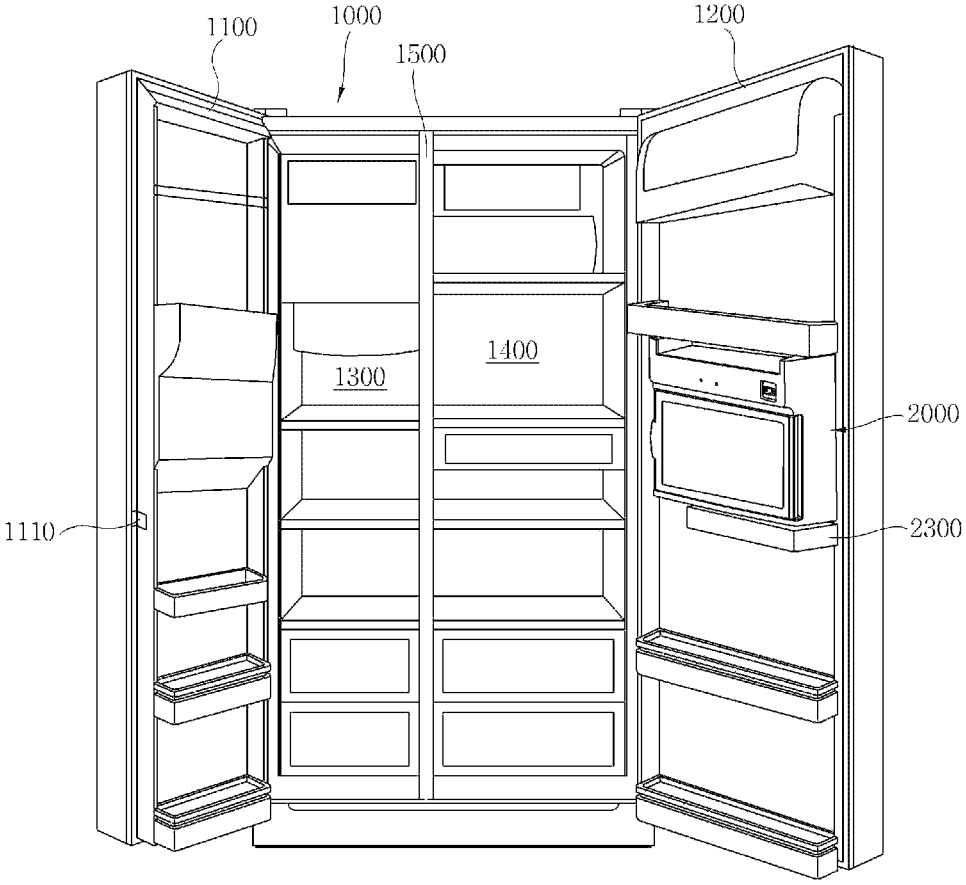
FIG. 8 is a view of a cooling apparatus according to a fourth embodiment of the present invention.

FIG. 8 is a view of a cooling apparatus according to a fourth embodiment of the present invention. According to the fourth embodiment of the present invention, a non-freezing apparatus 2000 is installed in a refrigerating chamber door 1200 of the cooling apparatus 1000. Like the second embodiment, when the non-freezing apparatus 2000 is installed in the refrigerating chamber door 1200, the cooling apparatus 1000 should include a cooling passage guide duct 2300 to introduce the cool air into the non-freezing apparatus 2000. Since the guide duct 2300 should not disturb the movement of a freezing chamber door 1100 and the refrigerating chamber door 1200, it is preferably installed below the non-freezing apparatus 2000. Moreover, an opening portion 1110 for introducing the cool air into the guide duct 2300 is formed in the freezing chamber door 1100, thereby forming a passage introducing the cool air into the guide duct 2300 through the opening portion 1110 and then introducing the cool air into the non-freezing apparatus 2000 to cool the non-freezing apparatus 2000. A damper controlling the inflow of the cool air from the passage may be installed on the opening portion 1110 or in the guide duct 2300. Preferably, the damper is located in the guide duct 2300 below the non-freezing apparatus 2000. That is, the damper installed below the non-freezing apparatus 2000 is covered with the guide duct 2300. A separate home bar (not shown) may be installed in the refrigerating chamber door 1200. Here, the relative positions of the home bar and the non-freezing apparatus 2000 may be determined regardless of order. If the damper is closed, the non-freezing apparatus 2000 is cooled according to a first cooling method in which the cool air in the cooling apparatus 1000 indirectly cools the non-freezing apparatus 2000. In the meantime, if the damper is open, while the cool air in the cooling apparatus 1000 is circulated around the non-freezing apparatus 2000 to indirectly cool the non-freezing apparatus 2000, a second cooling method is performed, in which the cool air is introduced into the non-freezing apparatus 2000 through the damper and circulated directly in the non-freezing apparatus 2000.

Figure 9:
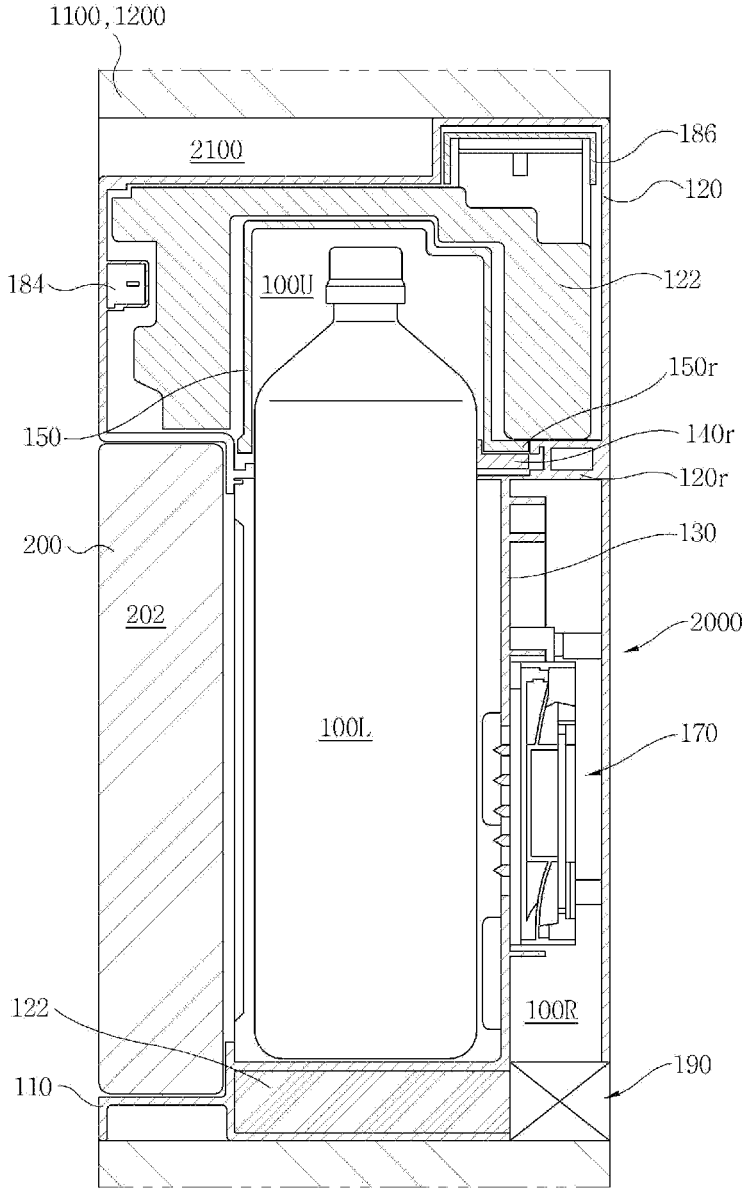
FIG. 9 is a view of a cooling apparatus according to a fifth embodiment of the present invention.

FIG. 9 is a view of a cooling apparatus according to a fifth embodiment of the present invention. According to the fifth embodiment of the present invention, a non-freezing apparatus 2000 is installed in a freezing or refrigerating chamber door 1100 or 1200 in home bar type. The non-freezing apparatus 2000 includes a door 200 having the same external appearance as the freezing or refrigerating chamber door 1100 or 1200 and forming a flat surface with the freezing or refrigerating chamber door 1100 or 1200 when viewed from the outside. That is, the inner space 1000 and 100L of the non-freezing apparatus 2000 serves as a storing space of the home bar installed in the freezing or refrigerating chamber door 1100 or 1200, and the door 200 of the non-freezing apparatus 2000 serves as a door of the home bar. As the door 200 of the non-freezing apparatus 2000 serves as the door of the home bar, the door 200 is filled with a thermal insulator 202. Meanwhile, the door of the cooling apparatus 1000 in which the non-freezing apparatus 2000 is installed in home bar type may be the freezing chamber door 1100 or the refrigerating chamber door 1200. If the non-freezing apparatus 2000 is installed in the refrigerating chamber door 1200, required is a separate passage introducing the cool air from the freezing chamber door 1100. A passage guide structure forming the passage may employ the opening portion 1110 (see FIG. 8) and the guide duct 2300 (see FIG. 8) explained in the fourth embodiment. In the meantime, a damper (not shown) controlling the inflow of the cool air may be installed on the passage introducing the cool air into the non-freezing apparatus 2000, e.g., on the opening portion, in the guide duct, or on the non-freezing apparatus 2000. On the other hand, if the non-freezing apparatus 2000 is installed in the cooling apparatus 1000 in home bar type, when a user uses the non-freezing apparatus 2000, the user does not have to open the freezing chamber door 1100 or the refrigerating chamber door 1200 but opens the door 200 of the non-freezing apparatus 2000. Thus, the outdoor air is not introduced into a freezing chamber 1300 or a refrigerating chamber 1400. Accordingly, since the temperature of the freezing chamber 1300 or the refrigerating chamber 1400 is not raised, the stability of the food storage and the energy efficiency can be improved. Moreover, although the door 200 of the non-freezing apparatus 2000 is open, the area corresponding to the door 200 of the non-freezing apparatus 2000 is exposed to the outdoor air, but the rear space of the non-freezing apparatus 2000 is located in the cooling space of the cooling apparatus 1000, which prevents a sudden rise in the temperature in the non-freezing apparatus 2000. As a result, while the door 200 of the non-freezing apparatus 2000 is open, food can be stably stored in a non-frozen state in the non-freezing apparatus 2000.

Figure 10:
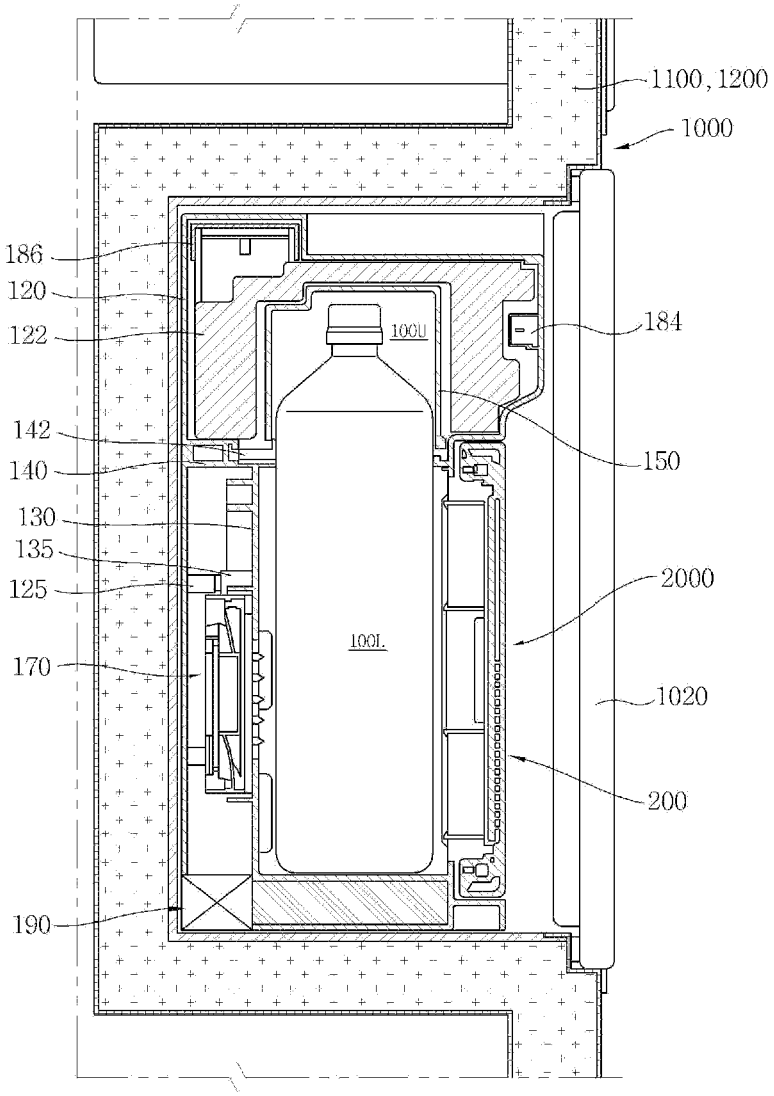
FIGS. 10 and 11 are views of a cooling apparatus according to a sixth embodiment of the present invention.
Figure 11:
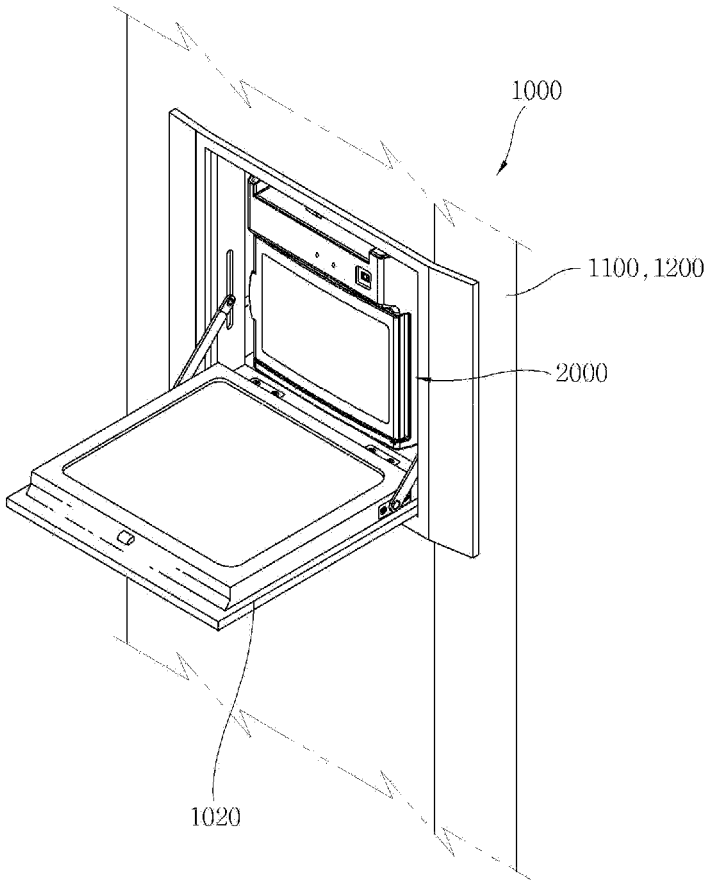

FIGS. 10 and 11 are views of a cooling apparatus according to a sixth embodiment of the present invention. According to the sixth embodiment of the present invention, a non-freezing apparatus 2000 is separately installed in a home bar of a freezing or refrigerating chamber door 1100 or 1200 of the cooling apparatus 1000. Like a general home bar, the freezing or refrigerating chamber door 1100 or 1200 includes a receiving space and a home bar door 1020 opening and closing the receiving space on the outside of the cooling apparatus 1000. The non-freezing apparatus 2000 is installed in the receiving space in the same shape as the non-freezing apparatus 2000 shown in FIGS. 12 to 19. That is, so as to take a container out of the non-freezing apparatus 2000, a user should open the home bar door 1020 of the cooling apparatus 1000 and then open a door 200 of the non-freezing apparatus 2000. In this situation, there is the inconvenience of use that the user must open the home bar door 1020 and the door 200 of the non-freezing apparatus 2000. However, since a loss of the cool air is minimized and a temperature change in the inner space of the non-freezing apparatus 2000 is extremely small, food can be stably stored in a non-frozen state without a sudden change in temperature. When the non-freezing apparatus 2000 is installed in the general home bar, the home bar may be installed in the refrigerating chamber door 1200 or the freezing chamber door 1100. In addition, as described above, when the non-freezing apparatus 2000 is installed in the home bar provided in the refrigerating chamber door 1200, required is a separate passage introducing the cool air from a freezing chamber 1300 into the home bar provided in a refrigerating chamber 1400. Moreover, a damper controlling the cool air flowing into the non-freezing apparatus 2000 is installed on the passage introducing the cool air, thereby controlling the cool air flowing into the non-freezing apparatus 2000.

Figure 12:
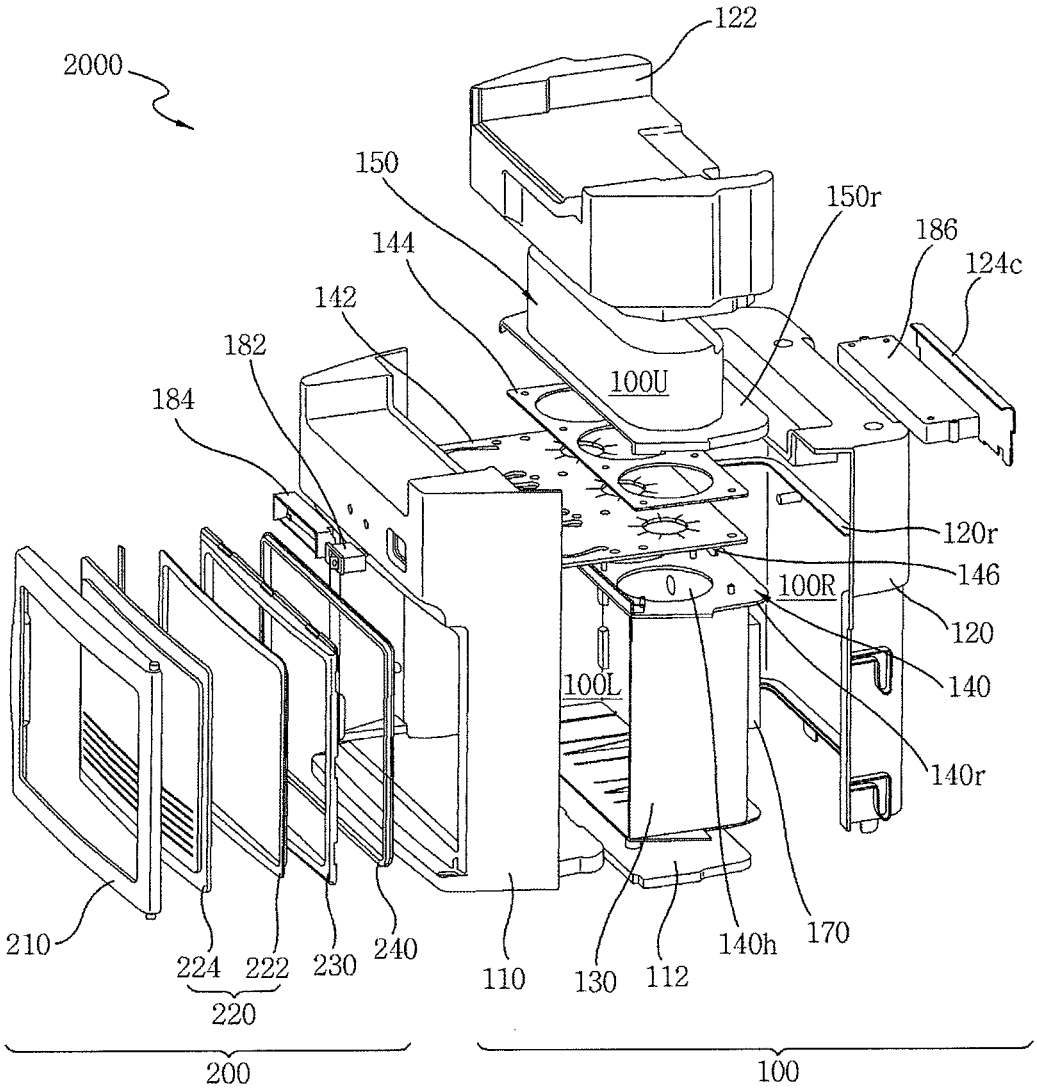
FIGS. 12 and 13 are exploded perspective views of a non-freezing apparatus according to an embodiment of the present invention.
Figure 13:
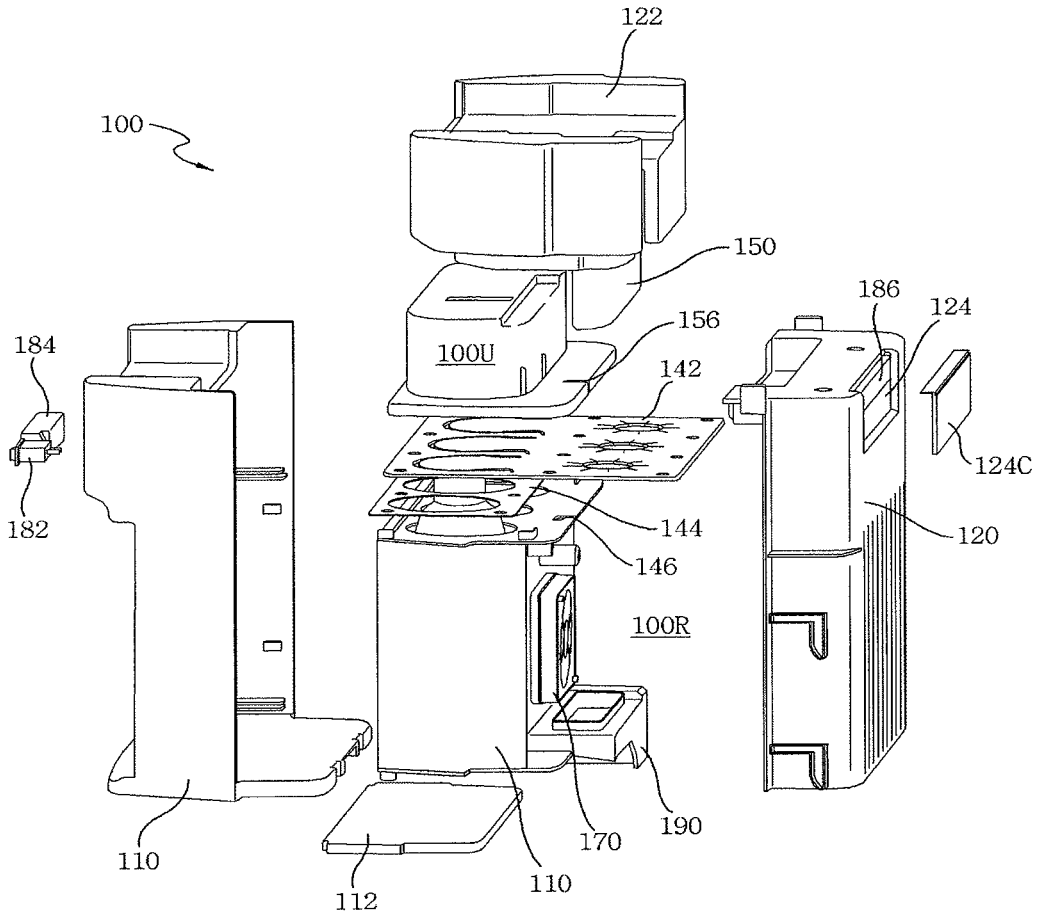

FIGS. 12 and 13 are exploded perspective views of a non-freezing apparatus according to an embodiment of the present invention.

The non-freezing apparatus 2000 according to the embodiment of the present invention includes a casing 100 defining the inner space for storing a container and a door 200 opening and closing the casing 100, and is installed in a cooling apparatus 1000 storing food at a temperature below 0° C. such as a freezing chamber of the cooling apparatus 1000. The casing 100, which separates the outer space, i.e., the space of the cooling apparatus 1000 in which the non-freezing apparatus 2000 is installed from the inner space of the non-freezing apparatus 2000, includes outer casings 110 and 120 forming the external appearance of the non-freezing apparatus 2000. The outer casings 110 and 120 include a front outer casing 110 and a rear outer casing 120. The front outer casing 110 forms the external appearance of the front and lower portions of the non-freezing apparatus 2000, and the rear outer casing 120 forms the external appearance of the rear and upper portions of the non-freezing apparatus 2000. The casing 100 enables upper and lower portions of container containing a liquid to be located and stored in different temperature regions. More specifically, the lower portion of the container is located in a temperature region (about −1° C. to −5° C.) of the maximum ice crystal formation zone, and the upper portion of the container is located in a higher temperature region (about −1° C. to 2° C.) in which the ice crystals are not easily formed. For this purpose, the casing 100 includes a lower space 100L having the temperature region (about −1° C. to −5° C.) of the maximum ice crystal formation zone, and an upper space 1000 having the temperature region (about −1° C. to 2° C.) in which the ice crystals are not easily formed. The upper space 100U and the lower space 100L are separated by a bulkhead 140. The casing 100 includes a lower casing 130 defining the lower space 100L with the bulkhead 140 and an upper casing 150 defining the upper space 1000 with the bulkhead 140. Further, a hole **140*h* is formed in the bulkhead 140 so that the upper portion of the container can pass through the bulkhead 140 and be located in the upper space 100**U.

A flow fan 170 is installed at the rear of the lower space 100L so that the liquid stored in the lower portion of the container located in the lower space 100L can rapidly reach the temperature region (about −1° C. to −5° C.) of the maximum ice crystal formation zone and have a supercooled state. In addition, a lower heater (not shown) is provided to adjust the temperature of the lower space 100L. An upper heater (not shown) is installed adjacent to the upper casing 150 so that the upper portion of the container located in the upper space 1000 can be maintained in the temperature region (about −1° C. to 2° C.) in which the ice crystals are not easily formed. Moreover, a separation film 142 made of an elastic material and covering the hole **140*h* of the bulkhead 140 is installed on the bulkhead 140 to prevent the heat exchange from occurring between the upper space 100U and the lower space 100L having different temperatures due to a forcible flow produced by the flow fan 170. Further, preferably, fixing plates 144, which can be fixed to the bulkhead 140 by screws or the like, are provided to press the separation film 142 in the up-down direction to fix the separation film 142 to the bulkhead 140**.

Meanwhile, a thermal insulator 112 for insulating the lower space 100L from the outer space is provided at the lower portions of the outer casings 110 and 120, and a thermal insulator 122 for insulating the upper space 100U from the outer space is provided at the upper portions of the outer casings 110 and 120. In addition, a power switch 182, a display unit 184 and the like are installed between the front outer casing 110 and the thermal insulator 122, and the PCB (not shown) controlling electronic components, such as the power switch 182, the display unit 184, the upper and lower heaters (not shown), the flow fan 170 and a damper 190, and a PCB installation portion 186 are installed between the rear outer casing 120 and the thermal insulator 122. The rear outer casing 120 further includes an opening portion 124 through which the PCB installation portion 186 can be detached in an assembled state of the outer casings 110 and 120 for the PCB installation, and a PCB cover **124*c* covering the opening portion 124 after the mounting of the PCB installation portion 186**.

In the meantime, a bulkhead is formed to prevent the cool air from flowing from the lower portion of the rear space 100R to the upper portion thereof and reducing the temperature of the upper space 100U. A rib **120*r* formed on the rear outer casing 120 and a rib 140*r* formed on the bulkhead 140 of the upper portion of the lower casing 130 to protrude from the lower casing 130 backwards overlap with each other, thereby forming the bulkhead. Preferably, a rib 150***r* having a shape corresponding to that of the bulkhead 140 of the upper portion of the lower casing 130 is provided at the lower portion of the upper casing 150 to protrude therefrom backwards. The rib 120*r* formed on the rear outer casing 120, the rib 140*r* formed on the bulkhead 140 and the rib 150*r* formed on the upper casing 150 overlap with each other, thus forming the bulkhead of the rear space 100R.

The door 200 is installed on the front surface of the front outer casing 110 to open and close the lower space 100L. The door 200 includes a door panel 220 made of a transparent or semitransparent material in a door casing 210, a door frame 230 fixed to the door casing 210 and fixing the door panel 220 therewith, and a gasket 240 mounted at the rear of the door frame 230 and sealing up between the door 200 and the front outer casing 110. The non-freezing apparatus 2000 according to the embodiment of the present invention includes a plurality of door panels 220. The respective door panels 220 are installed between the door casing 210 and the door frame 230 with a gap such that air layers are formed between the door panels 220. The air layers not only compensate for a low thermal insulation property of the door 200 but also prevent the frosting of the door 200, i.e., the door panels 220. The gasket 240 is made of an elastic material to seal up the gap between the door 200 and the front outer casing 110, thereby preventing the heat exchange from occurring between the cooling space 1300 and 1400 in which the non-freezing apparatus 2000 is mounted and the inside of the non-freezing apparatus 2000. That is, the gasket 240 can prevent leakage of the cool or hot air.

Meanwhile, a rear space R is defined by the rear outer casing 120, the lower casing 130 and the upper casing 150. The flow fan 170, the damper 190 and the lower heater (not shown) are installed in the rear space R. Particularly, the PCB installation portion 186 is installed at the upper portion of the rear space R to be detachable therefrom. The lower heater (not shown), the upper heater (not shown), the lower sensor (not shown), the upper sensor (not shown), the flow fan 170, the damper 190, the power switch 182 and the display unit 184 are connected to the PCB through an electric wire. The PCB is fixed in the PCB installation portion 186, and then the PCB installation portion 186 is fitted into a groove formed in the thermal insulator 122 of the upper space through the opening portion 124 formed in the rear outer casing 120. The electric wire connecting the PCB to the respective electronic components is connected to the PCB with a sufficient length to pull out the PCB installation portion 186 through the opening portion 124 of the rear outer casing 120. Accordingly, when the PCB is to be repaired or replaced, it is not necessary to separate the front outer casing 110 from the rear outer casing 120, which improves the convenience of maintenance and repair. In addition, grooves 146 and 156 are provided in the upper portion of the lower casing 130 and the lower portion of the upper casing 150, respectively, so that the electric wire connecting the PCB to the respective electronic components can be fitted thereinto. The upper portion of the lower casing 130 and the lower portion of the upper casing 150 are fixed to each other in an overlapping manner. The separation film 142 or the fixing plate 144 described above are located between the upper portion of the lower casing 130 and the lower portion of the upper casing 150. Moreover, when the PCB installation portion 186 is inserted into the thermal insulator 122 of the upper space in the rear outer casing 120, the opening portion 124 is closed by the PCB cover 124*c*. If the cool air of the cooling space infiltrates through the opening portion 124 during the operation, there is the possibility of lowering the temperature of the upper space 100U which should be maintained at a higher temperature than that of the lower space 100L, in addition to the cooling space. Therefore, there is a disadvantage in that a heating value of the upper heater (not shown) should be increased. When the opening portion 124 is closed by the PCB cover 124*c*, the energy efficiency can be improved and the liquid can be stably changed to the supercooled state.

Figure 14:
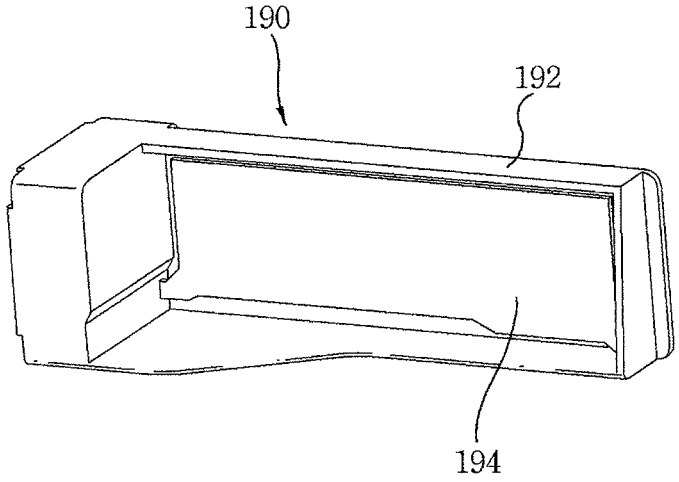
FIGS. 14 to 16 are views of a damper provided in the non-freezing apparatus according to the embodiment of the present invention.
Figure 15:
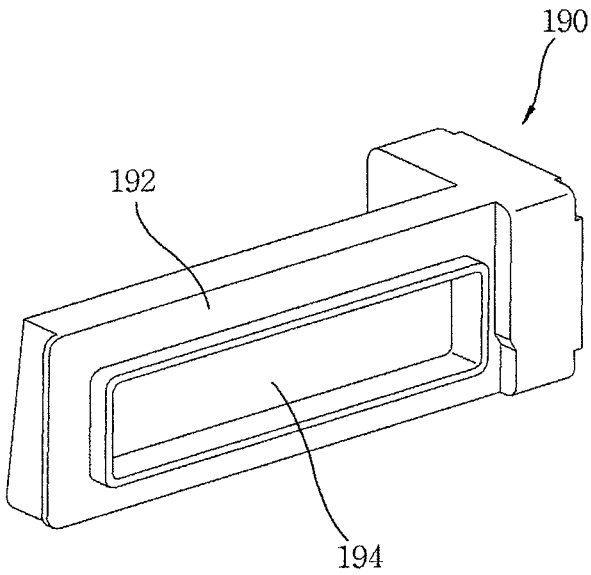
Figure 16:
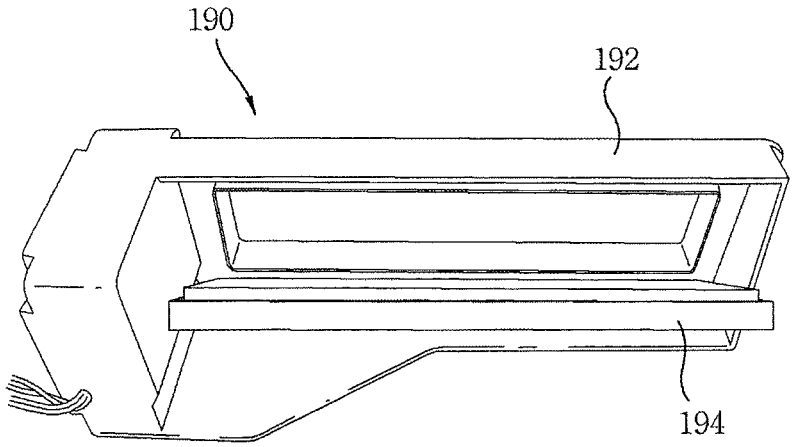

FIGS. 14 to 16 are views of the damper provided in the non-freezing apparatus according to an embodiment of the present invention. As described above, the damper 190 is installed in the rear space 100R (see FIG. 12) and controls the inflow of the cool air from the cooling space in which the non-freezing apparatus 2000 is installed to the rear space 100R (see FIG. 12). The damper 190 includes a frame 192 installed on the rear outer casing 120 and a baffle 194 pivoting to open or close an opening portion of the frame 192. The damper 190 is connected to the PCB via an electric wire, and the PCB controls the opening and closing of the damper 190 according to temperature information of the lower space 100L measured by a sensor (not shown). If the damper 190 is closed, the non-freezing apparatus 2000 is cooled according to a first cooling method in which the cool air in the cooling apparatus 1000 indirectly cools the non-freezing apparatus 2000. Meanwhile, if the damper 190 is open, while the cool air in the cooling apparatus 1000 is circulated around the non-freezing apparatus 2000 to indirectly cool the non-freezing apparatus 2000, a second cooling method is performed, in which the cool air is introduced into the non-freezing apparatus 2000 through the damper 190 and circulated directly in the non-freezing apparatus 2000. That is, when the non-freezing apparatus 2000 is cooled in the cooling apparatus 1000 according to the first cooling method, the second cooling method is selectively performed with the first cooling method according to the opening and closing of the damper 190. In other words, if the damper 190 is closed, the non-freezing apparatus 2000 is cooled according to the first cooling method, and if the damper 190 is open, the non-freezing apparatus 2000 is cooled according to the first cooling method and the second cooling method.

Figure 17:
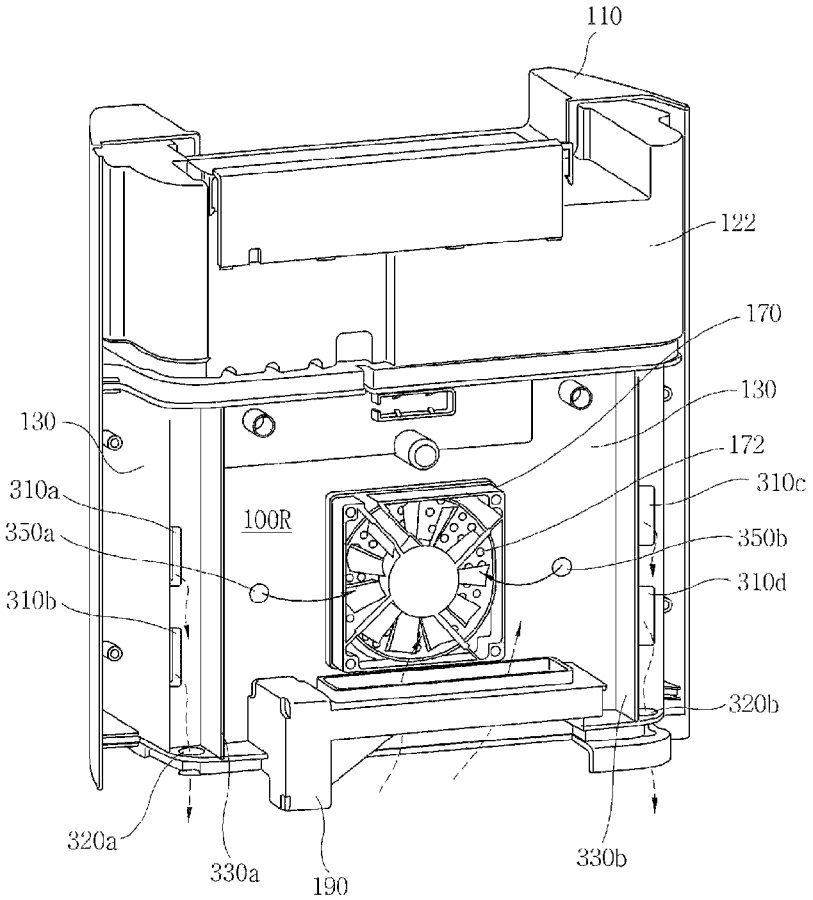
FIG. 17 is a view of a rear space of the non-freezing apparatus according to the embodiment of the present invention.
Figure 18:
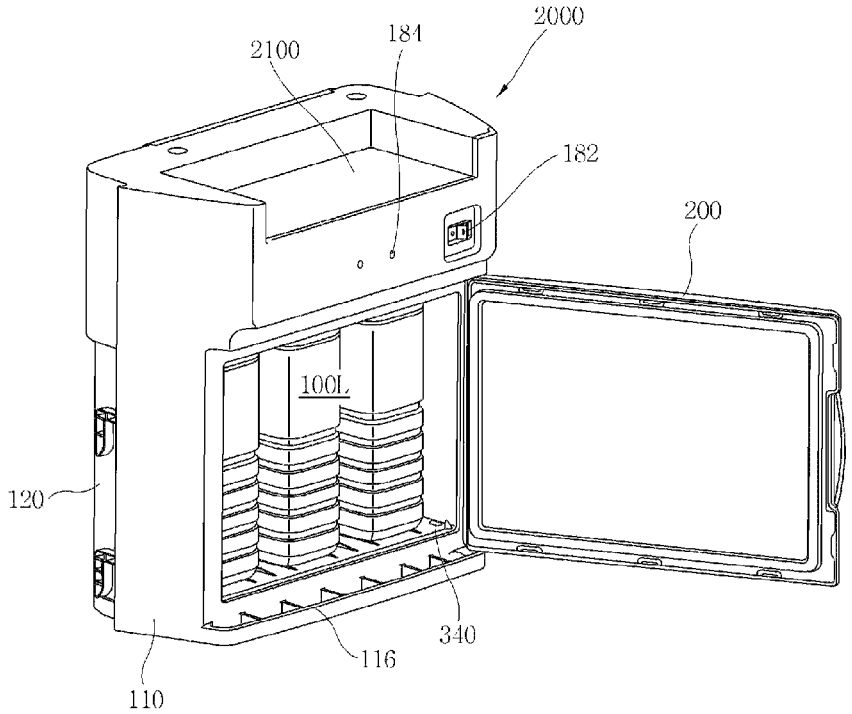
FIG. 18 is a perspective view of the non-freezing apparatus according to the embodiment of the present invention.

FIG. 17 is a view of the rear space of the non-freezing apparatus according to the embodiment of the present invention, and FIG. 18 is a perspective view of the non-freezing apparatus according to the embodiment of the present invention. As described above, the damper 190 is installed at the lower portion of the rear space 100R to control the inflow of the cool air. In addition, the flow fan 170 installed on the rear surface of the lower casing 130 produces a forcible flow such that the air introduced into the rear space 100R can be introduced into the lower space 100L and the air of the lower space 100L can be discharged again to the rear space 100R. A discharge grill 172 is provided in the installation position of the flow fan 170 in the lower casing 130 so that the flow produced by the flow fan 170 can flow therethrough, thereby forming a passage from the rear space 100R to the lower space 100L. Moreover, first discharge holes 310*a*, 310*b*, 310*c* and 310*d* are formed in the rear surface of the lower casing 130 to discharge the flow from the lower space 100L to the rear space 100R. The first discharge holes 310 are formed at both side ends. Four first discharge holes 310*a*, 310*b*, 310*c* and 310*d* are formed in twos in the up-down direction. The flow produced by the flow fan 170 is introduced into the lower space 100L through the discharge grill 172, and then discharged again through the first discharge holes 310*a*, 310*b*, 310*c* and 310*d* located at both side ends. Thus, a natural cooling passage is formed in the lower space 100L. In the meantime, second discharge holes 320 are formed in the lower portion of the lower space 100L to discharge the flow discharged through the first discharge holes 310*a*, 310*b*, 310*c* and 310*d* to the cooling space. Here, bulkheads 330*a* and 330*b* are installed between the flow fan 170 and the first discharge holes 310*a*, 310*b*, 310*c* and 310*d* to prevent the flow discharged through the first discharge holes 310*a*, 310*b*, 310*c* and 310*d* from flowing to the central portion in which the flow fan 170 is located and flowing into the lower space 100L again. Further, some of the flow flowing into the lower space 100L through the first discharge holes 310*a*, 310*b*, 310*c* and 310*d* and cooling the liquid stored in the container is discharged directly to the cooling space through third discharge holes 340 located in the lower portion of the lower space 100L. Preferably, the third discharge holes 340 are formed in the left and right in the same number to form symmetric passages.

Accordingly, if the damper 190 is open and the flow fan 170 is in operation, the cool air is introduced from the cooling space to the rear space 100R through the damper 190, and then introduced from the rear space 100R to the lower space 100L through the discharge grill 172, thus cooling the lower portion of the container containing the liquid in the non-freezing apparatus 2000. Some of the flow exchanging heat with the liquid contained in the container and cooling the liquid is discharged directly to the cooling space through the third discharge holes 340 located at both sides of the lower portion of the lower space 100L. The rest of the flow is discharged to the rear space 100R through the first discharge holes 310*a*, 310*b*, 310*c* and 310*d* of both side ends, and then discharged to the outside (cooling space) through the second discharge holes 320*a* and 320*b*.

Meanwhile, fourth discharge holes 350*a* and 350*b* are further formed in the lower casing 130 to be located inside the bulkheads 330*a* and 330*b*. That is, the bulkheads 330*a* and 330*b* exist between the fourth discharge holes 350*a* and 350*b*, and the first discharge holes 310*a*, 310*b*, 310*c* and 310*d* and the second discharge holes 320*a* and 320*b*. In a state where the damper 190 is closed, when the flow fan 170 is operated, the flow discharged from the rear space 100R to the lower space 100L through the discharge grill 172 is circulated in the lower space 100L and discharged again to the rear space 100R through the fourth discharge holes 350*a* and 350*b*. That is, when it is determined that the temperature of the lower space 100L reaches an appropriate temperature for storing the liquid in the supercooled state, in a state where the damper 190 is closed, the flow is circulated between the lower space 100L and the rear space 100R through the discharge grill 172 and the fourth discharge holes 350*a* and 350*b*, and the cool air is not introduced any more from the external cooling space.

Referring to FIG. 18, a trough 116 is formed at a contact portion of the door 200 and the front outer casing 110. The trough 116 prevents dews or moisture deposited on the container from being frozen on the door 200 or the front outer casing 110. Without the trough 116, the door 200 and the front outer casing 110 are not closely attached to each other but have a gap therebetween, and the cool air infiltrates into the gap and lowers the temperature of the lower space 100L. That is, since the dews deposited on the door 200 or the front outer casing 110 are dropped and collected in the trough 116, the frosting or freezing of the moisture does not occur on the bottom surface of the front outer casing 110 brought into contact with the door 200.

Figure 19:
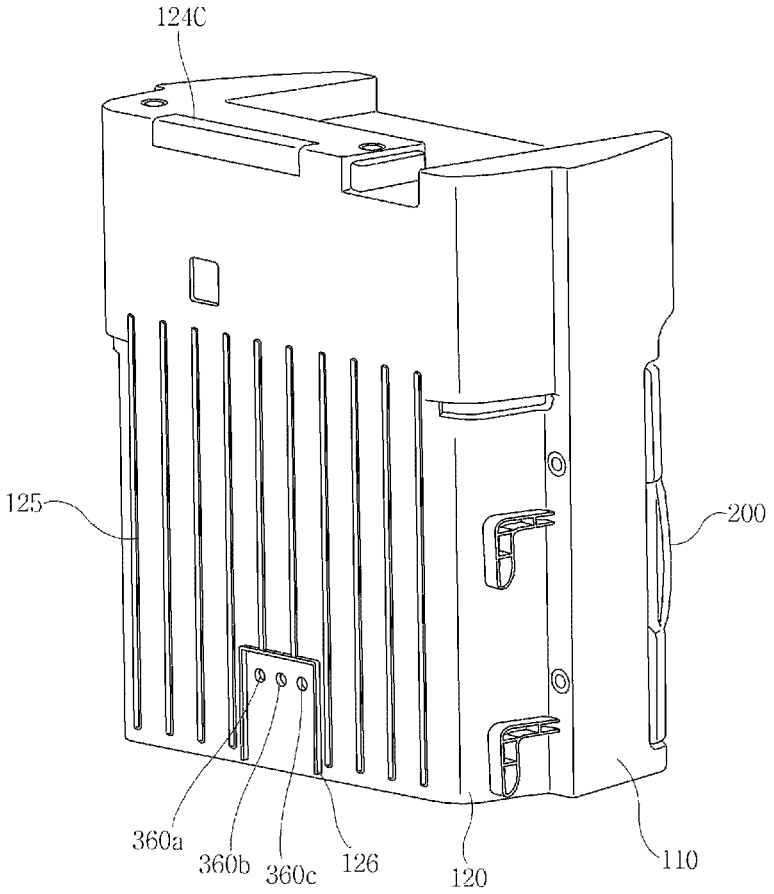
FIG. 19 is a view of the rear of the non-freezing apparatus according to the embodiment of the present invention.

FIG. 19 is a view of the rear of the non-freezing apparatus according to the embodiment of the present invention. Fifth discharge holes 360*a*, 360*b* and 360*c* are formed in a center of the rear surface of the rear outer casing 120 to discharge the flow from the rear space 100R to the cooling space. Some of the cool air introduced from the cooling space to the rear space 100R through the damper 190 is not introduced into the lower space 100L through the discharge grill 172 but discharged again to the cooling space through the fifth discharge holes 360*a*, 360*b* and 360*c*.

In the meantime, a plurality of ribs 125 are formed on the rear surface of the rear outer casing 120. The ribs 125 serve to leave a spacing between the rear surface of the rear outer casing 120 and the installation surface. When the non-freezing apparatus 2000 is installed in the cooling apparatus 1000 like the embodiment of the present invention, the ribs 125 maintain a spacing between the inner surface of the cooling apparatus 1000 and the rear surface of the rear outer casing 120. The inner surface of the cooling apparatus 1000 includes the inner surfaces of the freezing chamber door 1100 and the refrigerating chamber door 1200. In addition, a separate rib 126 is provided to enclose the fifth discharge holes 360*a*, 360*b* and 360*c* formed in the center of the rear surface of the rear outer casing 120 so that the flow discharged through the fifth discharge holes 360*a*, 360*b* and 360*c* of the rear outer casing 120 can be guided to the lower portion of the rear outer casing 120. The separate rib 126 encloses the fifth discharge holes 360*a*, 360*b* and 360*c* in three sides except the lower side such that the flow discharged through the fifth discharge holes 360*a*, 360*b* and 360*c* is naturally guided to the lower side of the non-freezing apparatus 2000.

Figure 20:
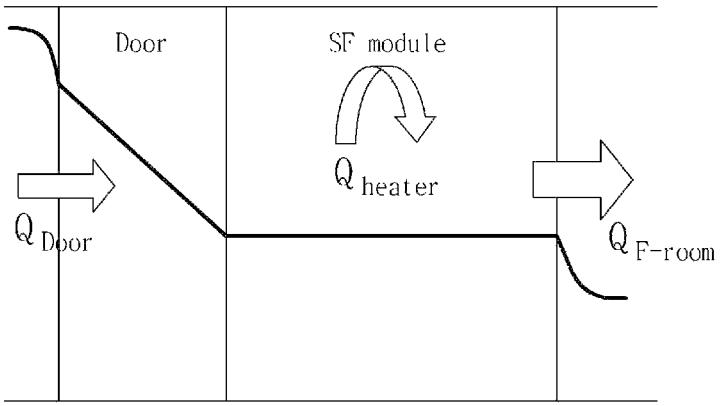
FIGS. 20 and 21 are schematic views showing the heat transfer comparison, when the non-freezing apparatus is closely attached to the cooling apparatus and when the non-freezing apparatus is spaced apart from the cooling apparatus by a given gap.
Figure 21:
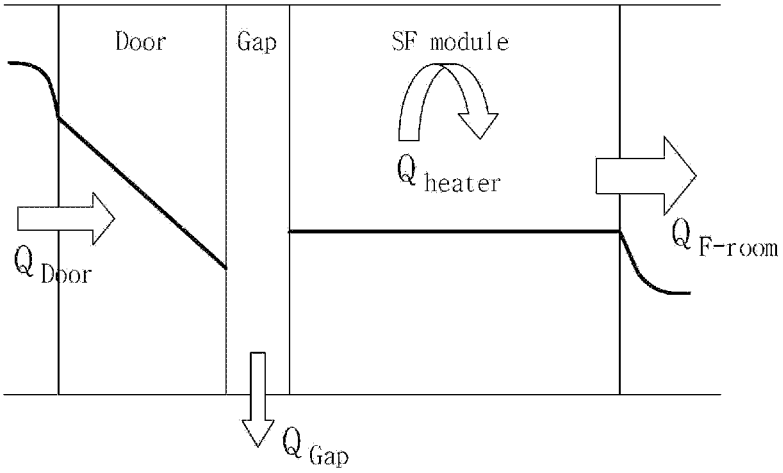

FIGS. 20 and 21 are schematic views showing the heat transfer comparison, when the non-freezing apparatus is closely attached to the cooling apparatus and when the non-freezing apparatus is spaced apart from the cooling apparatus by a given gap. As illustrated in FIG. 20, when the non-freezing apparatus 2000 is closely attached to the cooling apparatus 1000, the heat exchange occurs between the inner surface of the cooling apparatus 1000 and the contact surface of the non-freezing apparatus 2000, so that the inner surface of the cooling apparatus 1000 and the contact surface of the non-freezing apparatus 2000 have the same temperature. However, when the non-freezing apparatus 2000 is spaced apart from the cooling apparatus 1000 by the ribs 125, the non-freezing apparatus 2000 can be maintained at a different temperature from the inner surface of the cooling apparatus 1000. Therefore, the influence of the outdoor air of the cooling apparatus 1000 exerted on the non-freezing apparatus 2000 can be reduced. Moreover, after the temperature in the non-freezing apparatus 2000 is lowered to a temperature at which the liquid can be stored in a supercooled state, it is possible to reduce heating values of upper and lower heaters (not shown) installed in the non-freezing apparatus 2000, thereby improving the energy efficiency of the non-freezing apparatus 2000. When the non-freezing apparatus 2000 is closely attached to the cooling apparatus 1000, the heat transfer occurs to the cooling apparatus 1000. If the heater is operated so that the temperature in the non-freezing apparatus 2000 can be maintained in a given temperature region, the heat generated by the heater is used to raise the temperature of the inner surface of the cooling apparatus 1000 closely attached to the non-freezing apparatus 2000. Accordingly, when the non-freezing apparatus 2000 is spaced apart from the cooling apparatus 1000 by the given gap, the liquid can be rapidly changed to the supercooled state and the energy efficiency of the non-freezing apparatus 2000 can be improved.

Figure 22:
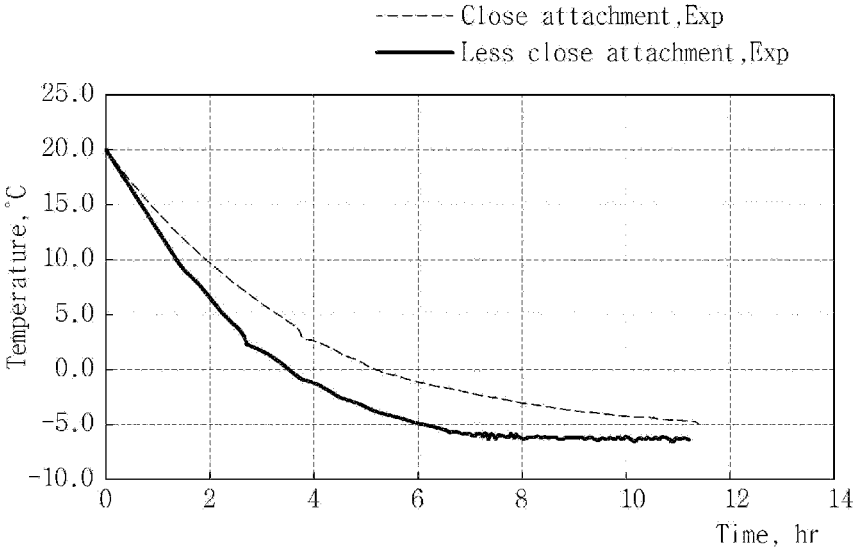
FIG. 22 is a graph showing changes in the internal temperature versus the time, when the non-freezing apparatus is closely attached to the cooling apparatus and when the non-freezing apparatus is spaced apart from the cooling apparatus by a given gap.

FIG. 22 is a graph showing changes in the internal temperature versus the time, when the non-freezing apparatus is closely attached to the cooling apparatus and when the non-freezing apparatus is spaced apart from the cooling apparatus by a given gap. As shown in the graph, when the non-freezing apparatus 2000 is spaced apart from the cooling apparatus 1000 by the given gap (less close attachment), it is cooled faster.

The present invention has been described in detail in connection with the exemplary embodiments and the accompanying drawings. However, the scope of the present invention is not limited thereto but is defined by the appended claims.

The invention claimed is:

1. A cooling apparatus, comprising:

a cooling space supplied with cool air;

a non-freezing apparatus installed in the cooling space, the non-freezing apparatus comprising:

a lower space maintained at a temperature of the maximum ice crystal formation zone;

an upper space maintained at a higher temperature than the lower space;

a first bulkhead located between the upper space and the lower space, the first bulkhead separating upper and lower portions of a container containing a stored object, said first bulkhead including a hole through which at least a portion of the container can pass, and said first bulkhead separates the upper space from the lower space in said non-freezing apparatus;

a rear space located at the rear of the lower space;

a damper controlling inflow of the cool air from the cooling space directly to the rear space;

a cooling passage for introducing the cool air from the rear space directly to the lower space;

a discharge passage including a first discharge hole for discharging the cool air directly from the lower space to the rear space and a second discharge hole for discharging the cool air discharged from the first discharge hole directly from the rear space to the cooling space; and a second bulkhead in the rear space between the cooling passage and the discharge passage, said second bulkhead preventing that cooled air discharged from the first discharge hole, in the rear space, to reach said cooling passage without passing through the second discharge hole.

2. The cooling apparatus of claim 1, wherein the non-freezing apparatus comprises a flow hole for introducing the cool air introduced through the damper into the lower space.

3. The cooling apparatus of claim 2, wherein the non-freezing apparatus comprises a flow fan installed on the flow hole and producing a forcible flow.

4. The cooling apparatus of claim 1, wherein the non-freezing apparatus comprises a third discharge hole for discharging the flow from the lower space to the cooling space.

5. The cooling apparatus of claim 1, wherein the non-freezing apparatus comprises a third discharge hole formed in the same space as the damper to discharge the cool air from the lower space to the rear space when the damper is closed.

6. The cooling apparatus of claim 5, wherein the third discharge hole is smaller in size than the first and second discharge holes.

7. The cooling apparatus of claim 1, wherein a rib defining a gap from an installation surface of the cooling apparatus is formed on the rear surface of the non-freezing apparatus.

8. The cooling apparatus of claim 1, wherein the non-freezing apparatus comprises a third discharge hole for discharging the cool air to the rear of the rear space.

9. The cooling apparatus of claim 1, further comprising a third bulkhead between the rear space and the upper space for preventing the cool air from flowing from a lower portion of the rear space to an upper portion of the rear space and reducing the temperature of the upper space.

10. The cooling apparatus of claim 1, wherein the non-freezing apparatus comprises a separation film made of an elastic material and covering the hole of the first bulkhead.

* * * * *